US006177642B1

(12) United States Patent
Matsuhashi

(10) Patent No.: US 6,177,642 B1
(45) Date of Patent: Jan. 23, 2001

(54) ADJUSTING MECHANISM FOR TOUCH SENSOR

(75) Inventor: Akira Matsuhashi, Tachikawa (JP)

(73) Assignee: Metrol Co., Ltd., Tachikawa (JP)

( * ) Notice: Under 35 U.S.C. 154(b), the term of this patent shall be extended for 0 days.

(21) Appl. No.: 09/342,180

(22) Filed: Jun. 29, 1999

(51) Int. Cl.[7] ..... H01H 3/16
(52) U.S. Cl. ..... 200/61.41; 200/61.42
(58) Field of Search ..... 200/61.41–61.43, 200/61.73, 61.74

(56) References Cited

U.S. PATENT DOCUMENTS 3,462,565 * 8/1969 Hall ..... 200/35
4,048,879 * 9/1977 Cox ..... 82/28 R
5,959,271 * 9/1999 Matsuhashi ..... 200/61.41

FOREIGN PATENT DOCUMENTS 60-10106 1/1985 (JP) .
3-15053 2/1991 (JP) .

* cited by examiner

*Primary Examiner*—Michael L. Gellner
*Assistant Examiner*—Nhung Nguyen
(74) *Attorney, Agent, or Firm*—Kanesaka & Takeuchi

(57) ABSTRACT

A touch sensor of the invention includes an adjusting mechanism to adjust a position of the touch sensor relative to a processing machine. The touch sensor includes an arm attached to the processing machine, a housing attached to the arm and having a sensor section with a contact and a flange, a fastening device for fastening the housing to the arm, and an eccentrically rotating device including an eccentric axis having a first axis and a second axis eccentrically attached to the first axis. A circular hole is formed in one of the housing and the arm to engage the first axis, and an elongated slot is provided in the other of the housing and the arm to engage the second axis. Upon rotation of the eccentric axis, a position of the contact attached to the housing is adjusted relative to the arm or processing machine.

8 Claims, 7 Drawing Sheets

ADJUSTING MECHANISM FOR TOUCH SENSOR

BACKGROUND OF THE INVENTION AND RELATED ART STATEMENT

The invention relates to an adjusting mechanism for a touch sensor attached to a forward edge of an arm provided to a lathe to detect a setting position of a bit and to send a detected signal.

FIGS. 8(*a*) and 8(*b*) are a plan view and a front view, respectively, for showing a conventional touch sensor to be connected to an arm of a lathe. In the front view in FIG. 8(*b*), only an arm is cut at its center to show its section.

As shown in FIG. 8(*b*), a touch sensor 71 is formed of a housing 73 having a plurality of contact portions 72, and a flange 74 at a lower part of the housing 73. When the touch sensor 71 is attached to an arm of a lathe (both not shown), a cylindrical portion 74*a* located below the flange 74 is inserted into a hole of the arm, and a plurality of bolts (not shown) passing through bolt holes 64*b* formed in the flange 74 is fastened to the arm. Incidentally, numeral 75 indicates an O-ring, and numeral 76 indicates lead wires.

A fastened plane surface between the flange 74 and an arm side flange is perpendicular to the respective contacts 72. In case the touch sensor 71 is attached to the arm, it is required that each contact 72 is perpendicular to or parallel to a center line of a main axis of the lathe. Since the flange 74 and the arm side flange are rotatable around a line Z–Z', after the contacts 72 are adjusted to be perpendicular to or parallel to the center line of the main axis of the lathe by rotating or tapping an outer periphery of the flange 74 with respect to the axis Z–Z' while slightly loosening the fastening screws, the fastening screws are tightly fastened.

According to the above described method, it is difficult to make a fine adjustment and is required to make adjustments several times, thus resulting in increase in adjusting steps.

To solve the above described problems, the present invention has been made, and an object of the present invention is to provide an adjusting mechanism for a touch sensor, which has a simple structure and can be adjusted easily.

Another object of the invention is to provide an adjusting mechanism for a touch sensor as stated above, wherein a fine adjustment can be carried out at an extremely short time.

A further object of the invention is to provide an adjusting mechanism for a touch sensor as stated above, wherein the touch sensor can be replaced easily if required.

Further objects and advantages of the invention will be apparent from the following description of the invention.

SUMMARY OF THE INVENTION

In the present invention, a touch sensor is attached to a forward edge of an arm provided to a lathe to detect a setting position of a bit and to send out a detected signal. An adjusting mechanism of the touch sensor includes a fastening device for fastening a flange provided to a housing of the touch sensor and having a reference surface perpendicular to contacts of the touch sensor, and an upper portion of the arm having an opposed surface to the flange for forming a reference surface perpendicular to the contacts; a fitting device for mutually rotating the housing and the arm on the reference surfaces provided to the flange and the arm; and an eccentrically rotating device having an eccentric axis formed of a first axis and a second axis eccentrically provided to the first axis. The first axis is fitted into a circular hole vertically provided in one of the reference surfaces, and the second axis is fitted into a slot provided in the other of the reference surfaces to extend radially from a rotation center of the fitting device. When the eccentric axis is rotated, positions of the contacts can be adjusted to be perpendicular to or parallel to a center of a main axis of the lathe.

Also, an adjusting mechanism of the touch sensor may include a fitting device for rotatably fitting a cylindrical guide of the touch sensor into a hollow hole provided to an upper portion of the arm; a fastening device for fastening a barrel portion provided to the lower portion of the housing of the touch sensor and having a reference surface perpendicular to the contacts of the touch sensor, and an upper portion of the arm having an opposed surface to the barrel portion for forming a reference surface perpendicular to the contacts; and an eccentrically rotating device having an eccentric axis formed of a first axis and a second axis provided eccentrically to the first axis. The first axis is fitted into a hole provided to a side wall of an upper portion of the arm and directed to a center of the arm, and the second axis is inserted into a groove provided to an outer periphery of a cylindrical guide of the touch sensor to be perpendicular to the reference surface.

When the eccentric axis is rotated, the positions of the contacts can be adjusted to be perpendicular to or parallel to a center of a main axis of the lathe.

BRIEF DESCRIPTION OF THE DRAWINGS

FIG. 1(*b*) is a front view thereof;

FIG. 2(*b*) is a plan view thereof;

FIG. 2(*c*) is a sectional view taken along line 2*c*—2*c* in FIG. 1(*a*);

FIG. 3(*b*) is a sectional view of a flange and an arm separated from each other;

FIG. 4(*b*) is a front view thereof;

FIG. 5(*b*) is a plan view thereof;

FIG. 5(*c*) is a sectional view taken along line 5*c*—5*c* in FIG. 4(*a*);

FIG. 7(*b*) is a sectional view taken along line 7*b*—7*b* in FIG. 7(*a*) of the fourth embodiment;

FIG. 8(*b*) is a partially cut front view thereof.

DETAILED DESCRIPTION OF PREFERRED EMBODIMENTS

Figure 1A:
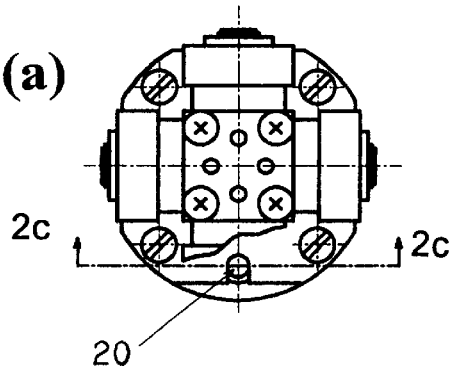
FIG. 1(*a*) is a plan view of an adjusting mechanism of a touch sensor of a first embodiment of the present invention.
Figure 1B:
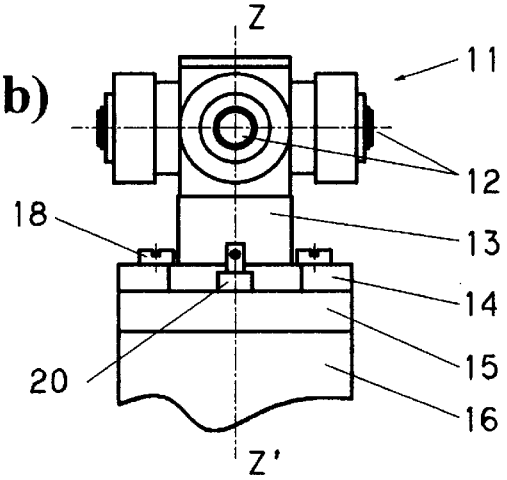

FIGS. 1(*a*)–3(*c*) show a first embodiment of an adjusting mechanism for a touch sensor according to the present invention.

In the drawings, numeral 11 represents a touch sensor main portion; 12 is a sensor section or contacts; 13 is a housing for the touch sensor main portion 11; 14 is a sensor side flange provided to the housing 13; and 15 is an arm side flange fastened to an arm 16 by screws or the like. The sensor side flange 14 and the arm side flange 15 are fastened together by fastening screws or devices 18. Also, a fastened plane between the sensor side flange 14 and the arm side flange 15 is perpendicular to the contacts 12. As explained later, a cylindrical portion of the touch sensor main portion 11 is fitted into a hollow hole of the arm 16, so that the sensor side flange 14 and the arm side flange 15 are rotatable around an axis Z–Z'.

Figure 3A:
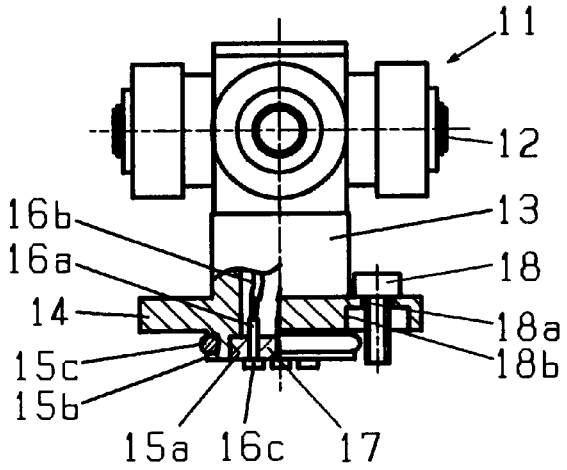
FIG. 3(*a*) is a partially cut rear view.
Figure 3B:
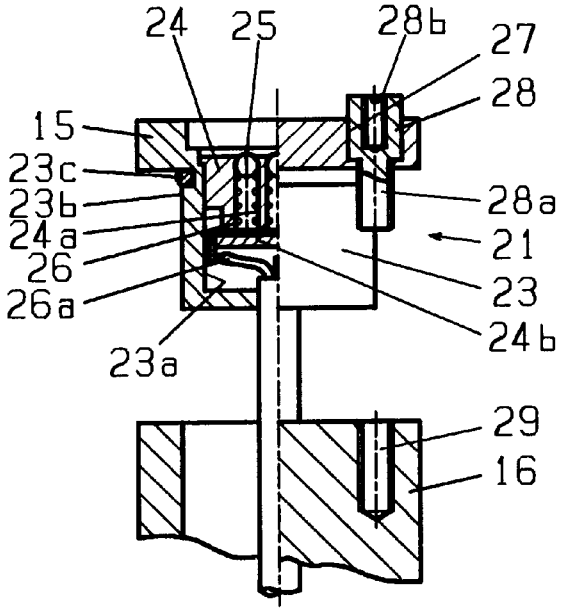

As shown in FIG. 3(*a*), an insulation plate 17 is fixed in an inner portion 15*a* of the flange 14 located at a lower side of the housing 13 of the touch sensor main portion 11. The insulation plate 17 has a plurality of terminal shafts 16*c* forming connectors. An inner end 16*a* of each terminal shaft 16*c* located in the housing 13 is soldered to a lead 16*b* extending to the contact 12. Also, the flange 14 has four bolt holes 18*a* corresponding to thread holes 29 formed at an end of the arm 16. A rear side of the flange 14 has dents 18*b* around the bolt holes 18*a*, and an O-ring 15*c* for sealing the flange 14 is attached around an outside portion of fitting device below the flange 14.

In FIG. 3(*b*), a base portion 21 is formed of an arm side flange or flange 15, i.e. second flange, and a cylindrical portion 23 with a wall 23*a*, in which an insulation member 24 is fixed. The insulation member 24 has holes 24*a* corresponding to the terminal shafts 16, in which a ball shape terminal 25 forming a connector and a compression spring 26 are inserted, respectively. A support plate 24*b* is fixed to the insulation member 24 after the terminals 25 and the springs 26 are inserted into the respective holes 24*a*. The ball shape terminal 25 is urged upwardly by the spring 26, but since the inner diameter of the hole 24*a* is less than the outer diameter of the ball shape terminal, the terminal 25 does not come out from the hole 24*a*. A lower end of the spring 26 projects downwardly through the support plate 24*b*, and is soldered to each lead line 26*a*. The flange 15 includes dents 27, centers of which are aligned with those of the bolt holes 18*a* and the thread holes 29. Also, an O-ring 23*c* for sealing is attached around an outside portion 23*b* of the cylindrical portion 23.

When the touch sensor main portion 11 is fixed to the arm 16, each male thread 28*a* of a fastening shaft 28 is disposed in each dent 27 of the flange 15 to pass therethrough, and is tightened into each thread hole 29. Thus, the flange 15 is fixed to the arm 16. Incidentally, the fastening shaft 28 includes a female thread 28*b* at a side opposite to the male thread 28*a*.

Then, each fastening screw 18 is inserted into each bolt hole 18*a*, and is fastened into the female thread 28*b* of the fastening shaft 28, so that the flange 14 is with the outside portion 15*b* fixed to the flange 15. The ball shape terminals 25 contact the terminal shafts 16*c* to electrically conduct thereto while the contact pressures are maintained by the springs 26.

Thus, the touch sensor main portion 11 can be easily attached to the arm 16. Also, the upper part of the touch sensor main portion 11 can be easily fixed to the flange 15 through the flange 14.

Figure 2A:
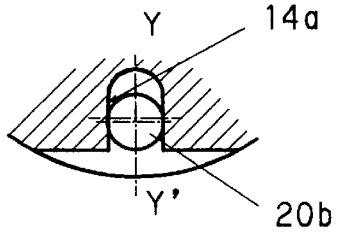
FIG. 2 is an enlarged sectional view taken along line 2*a*—2*a* in FIG. 2(*c*) of the first embodiment.
Figure 2B:
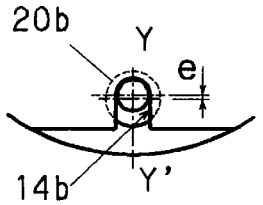
Figure 2C:
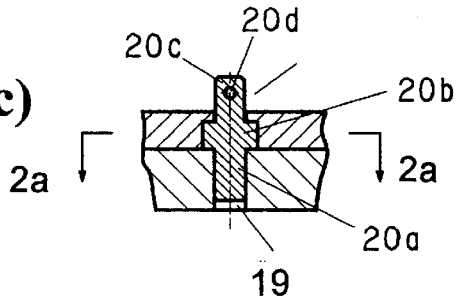

Numeral 20 is an eccentric axis or shaft at a front side, enlarged views of which are shown in FIGS. 2(*a*), 2(*b*) and 2(*c*). FIG. 2(*c*) is a section taken along line 2*c*—2*c* in FIG. 1(*a*); FIG. 2(*b*) is a plan view of FIG. 2(*c*); and FIG. 2(*a*) is a section taken along line 2*a*—2*a* in FIG. 2(*c*). The eccentric axis or shaft 20 includes a lower or first axis 20*a*, intermediate or second axis 20*b* and upper or third axis 20*c*. The lower axis 20*a* and the upper axis 20*c* have the same center lines and same outer diameters, while the intermediate axis 20*b* has a center line deviated by e with respect to the center line of the lower axis 20*a*, and has an outer diameter larger than that of the lower axis 20*a*.

Further, the lower axis 20*a* of the eccentric axis 20 is fitted into a hole or circular hole 19 provided to the arm side flange 15, and the intermediate axis 20*b* of the eccentric axis 20 is fitted, with a less play, into a U-shape groove or elongated slot 14*a* in a Y–Y' direction provided to the sensor side flange 14. Also, the upper axis 20*c* of the eccentric axis 20 projects into a U-shape hole 14*b* having the same center as the center Y–Y' of the U-shape groove 14*a* and a width narrower than that of the U-shape groove 14*a*, so that the eccentric axis 20 does not come out toward the upper direction, i.e. Z direction. Incidentally, numeral 20*d* is a small hole or adjusting portion for a pin-like driver for rotating the eccentric axis 20. Also, the U-shape groove may be a slot.

In the structure as described above, in case the pin-like driver is inserted into the small hole 20*d* of the eccentric axis 20 while slightly loosening the fastening screws 18 to rotate the eccentric axis 20, the eccentric axis 20 is rotated in the hole 19, into which the lower axis 20*a* of the eccentric axis 20 is inserted, so that the eccentric intermediate axis 20*b* rotates. Through the rotation of the eccentric intermediate axis 20*b*, a wall on one side of the U-shape groove 14*a* is pushed to rotate the sensor side flange 14 around the Z–Z' axis to thereby adjust the contacts 12 to be perpendicular to or parallel to the center line of a main axis of a lathe. Thereafter, the slightly loosened screws 18 are tightened to complete the adjusting work.

In this structure, the lower axis 20*a* of the eccentric axis 20 may be fitted into a U-shape groove or slot provided to the arm side flange 15, and the intermediate axis 20*b* of the eccentric axis 20 may be fitted into a hole provided to the sensor side flange 14.

Figure 4A:
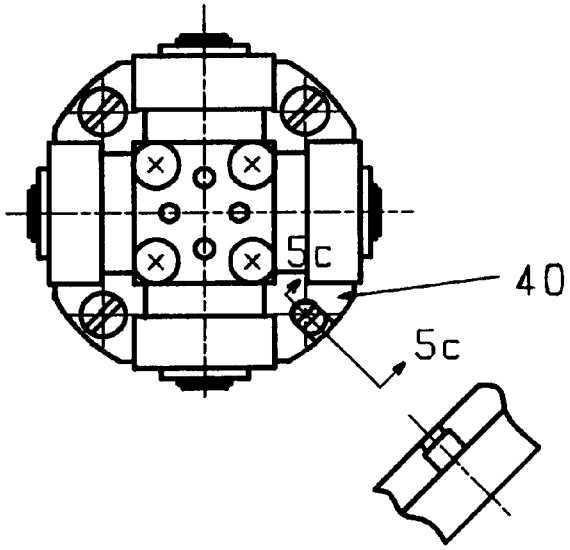
FIG. 4(*a*) is a plan view of a second embodiment of the invention.
Figure 4B:
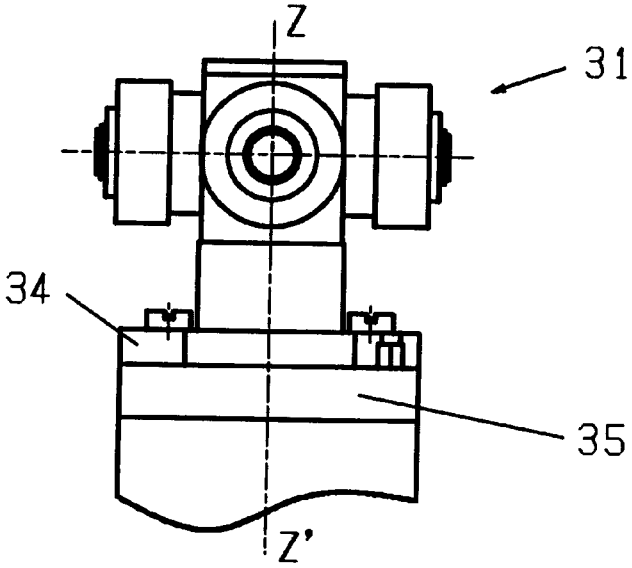
Figure 5A:
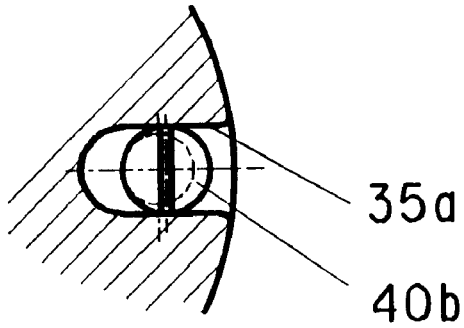
FIG. 5(*a*) is an enlarged sectional view taken along line 5*a*—5*a* in FIG. 5(*c*) of the second embodiment.
Figure 5B:
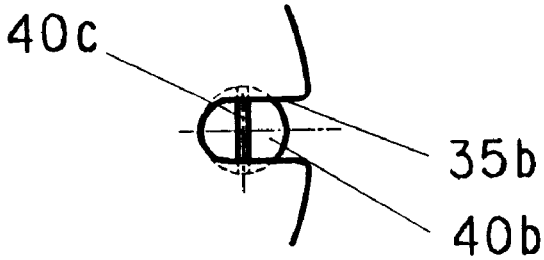
Figure 5C:
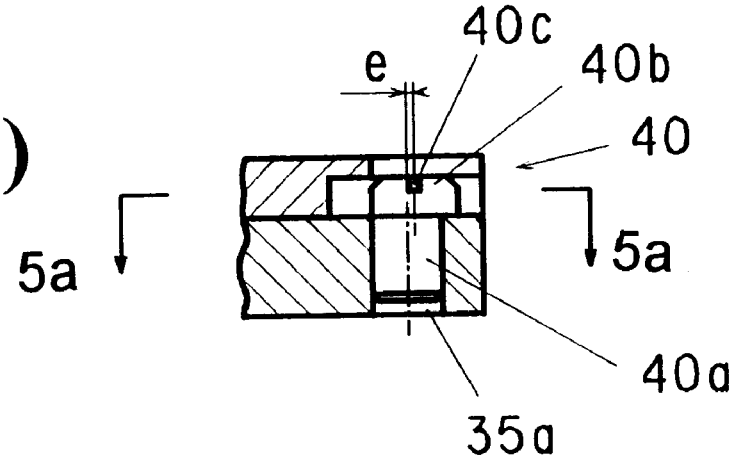

FIGS. 4(*a*), 4(*b*) and 5(*a*) to 5(*c*) show a second embodiment of an adjusting mechanism for a touch sensor 31 according to the invention, wherein FIG. 4(*a*) is a plan view; FIG. 4(*b*) is a front view; and FIGS. 5(*a*) to 5(*c*) are enlarged views of eccentric axis portions of FIGS. 4(*a*) and 4(*b*). FIG. 5(*c*) is a front view showing a section taken along line 5*c*—5*c* in FIG. 4(*a*); FIG. 5(*b*) is a plan view of FIG. 5(*c*); and FIG. 5(*a*) is a section taken along line 5*a*—5*a* of FIG. 5(*c*). In the first embodiment, the sensor side flange 14 and the arm side flange 15 are fastened by the four fastening screws 18, while in the second embodiment, they are fastened by the three fastening screws 38 and an eccentric axis is provided to a position corresponding to the fourth screw.

Only different points between the first and second embodiments are explained hereunder. An eccentric axis or shaft 40 includes a lower axis 40*a* and an upper axis 40*b*. The upper axis 40*b* has a center line deviated by e with respect to the center axis of the lower axis 40*a*, and the upper axis 40*b* has an outer diameter larger than that of the lower axis 40*a*. By the way, 40*c* is a slot for a driver provided to an upper surface of the upper axis 40*b*.

Further, the lower axis 40*a* of the eccentric axis 40 is fitted into a hole 35*a* provided to an arm side flange 35, and the upper axis 40*b* of the eccentric axis 40 is fitted, with a less play, into a U-shape groove 35*a* provided to a sensor side flange 34. Also, an upper part located above the upper axis 40*b* is provided with a U-shape hole 35*b* having the same center as that of the U-shape groove 35*a*, and a width narrower than that of the U-shape groove 35*a*, so that the eccentric axis 40 does not come off toward the upper direction, i.e. Z direction. Further, a forward end of the driver can be inserted into the hole 35*b*. Of course, instead of the U-shape groove, a slot may be used.

Regarding an adjusting method, only a difference between the first and second embodiments resides in that a pin-shape driver is used in the first embodiment, while in the second embodiment, a driver having a conventional linear or minus shape forward edge can be used.

Figure 6:
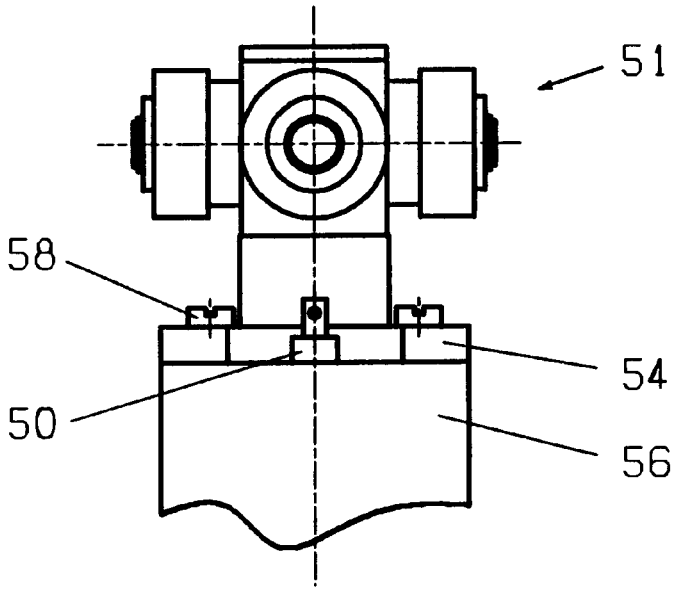
FIG. 6 is a front view of a third embodiment of the invention.

FIG. 6 is a front view showing a third embodiment 51 of the invention, wherein the arm side flange 15 in the first embodiment is omitted and a sensor side flange 54 is fastened directly to an edge surface of an arm 56 by fastening screws 58. In the first embodiment, the lower axis 20*a* of the eccentric axis 20 is fitted into the hole 15*a* provided to the arm side flange 15, but in the third embodiment, a lower axis, not shown, of an eccentric axis 50 corresponding to the lower axis 20*a* of the eccentric axis 20 is fitted into a hole, not shown, provided to the arm 56. Since the adjusting method of the third embodiment is the same as that of the first embodiment, the adjusting method of the third embodiment is omitted. The third embodiment can be applied to the second embodiment as a matter of course.

Figure 7A:
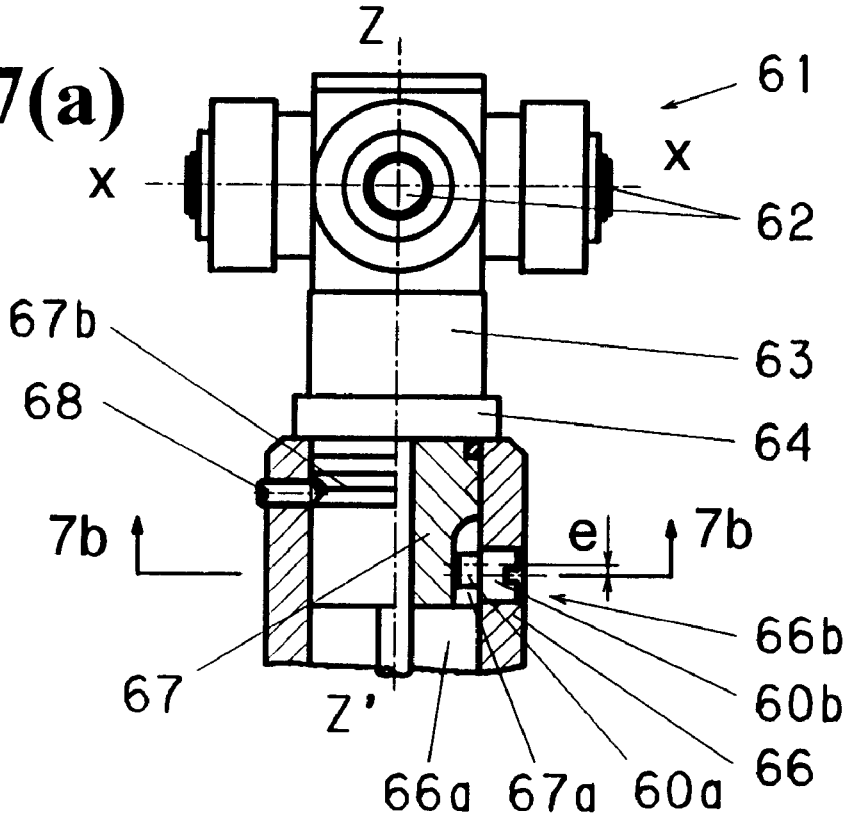
FIG. 7(*a*) is a front view partially in section of a fourth embodiment of the invention.
Figure 7B:
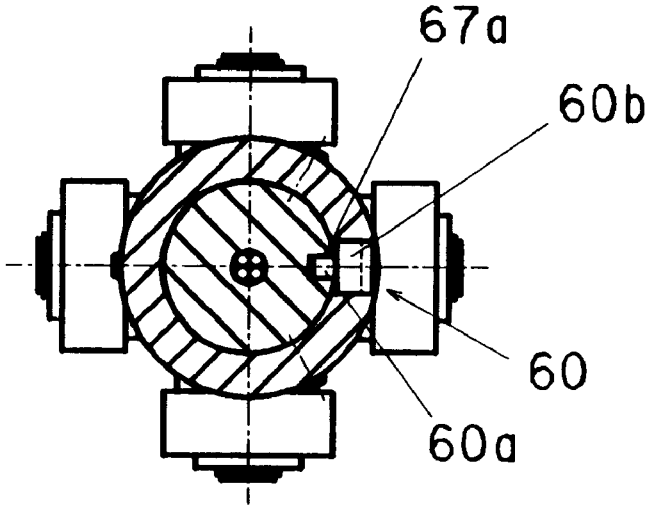
Figure 8A:
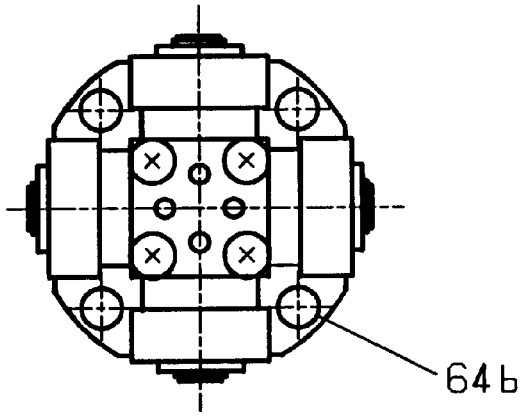
Fig. 8(a) Prior Art
FIG. 8(*a*) is a plan view of a conventional touch sensor.
Figure 8B:
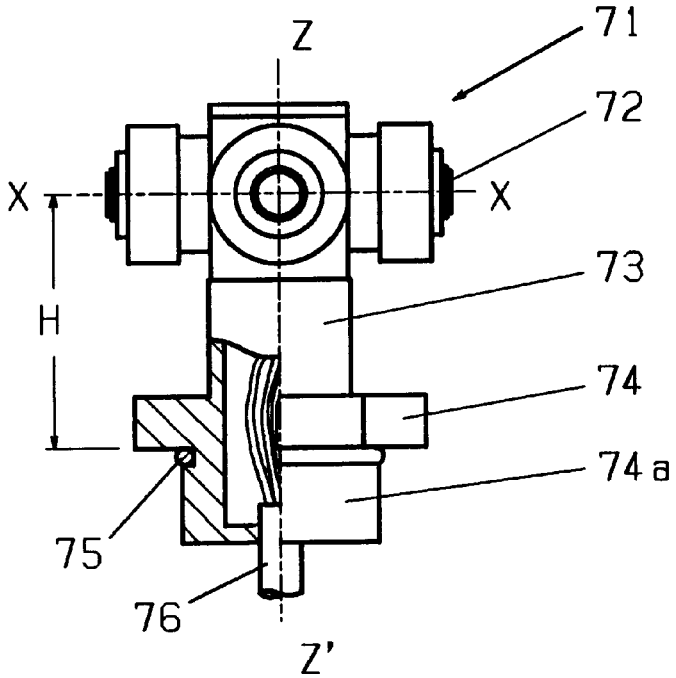
Fig. 8(b) Prior Art

FIGS. 7(*a*) and 7(*b*) show a fourth embodiment of the invention, wherein FIG. 7(*a*) is a front view, and FIG. 7(*b*) is a sectional view taken along line 7*b*—7*b* in FIG. 7(*a*). In FIG. 7(*a*), the right side with respect to the center line Z–Z' of a sensor main portion is a complete central section and the left side therewith is a section of only the arm. The first embodiment to the third embodiment are provided with eccentric axes having the center lines parallel to the center line Z–Z', while the fourth embodiment is provided with an eccentric axis disposed at an outer wall of the arm and having a center line directed to the center axis of the arm.

In FIGS. 7(*a*) and 7(*b*), numeral 61 represents a touch sensor main portion; 62 is contacts; 63 is a housing of the touch sensor main portion 61; 64 is a barrel or enlarged portion provided to the housing 63; 66 is an arm; and 67 is a cylindrical guide of the touch sensor main portion 61 and is fitted into a hollow hole 66*a* of the arm 66. Edge surfaces of the barrel portion 64 and the arm 66 are perpendicular to the contacts 62, i.e. the edge surfaces are located parallel to central axis X–X' of the contacts. A circular hole 66*b* directed to a center thereof is provided to an outer wall of the arm 66, and an upper axis 60*b* of an eccentric axis or shaft 60 is fitted thereinto. A lower axis 60*a* having a diameter smaller than that of the upper axis 60*b* and a center line deviated by e with respect to the center line of the upper axis 60*b* is slightly loosely fitted between side walls of a groove 67*a*, formed in the direction of Z–Z', of the cylindrical guide 67.

A V-shape groove 67*b* is formed on an outer periphery of the cylindrical guide 67, and three screw holes directed toward a center of the arm 66 are formed on the outer wall of the arm 66 to divide the outer wall into three equal parts. A central position of each screw hole is formed to be slightly lower than a center of the V-shape groove 67*b*, i.e. closer to Z'. Stop screws 68 each having a sharp point with the same angle as that of the V-shape groove 67*b* are screwed into the three screw holes, respectively. By equally screwing the stop screws 68 into the screw holes, the sharp points of the stop screws 68 press inclined surfaces located at a lower side than the V-shape groove 67*b*, i.e. closer to Z', so that the barrel portion 64 of the touch sensor main portion 61 abuts against the forward edge of the arm 66, and is fixed thereto.

In the above structure, the upper axis 60*b* of the eccentric axis 60 is fitted into the hole 66*b* formed in the outer side wall of the arm 66. However, a pipe-shape bush may be provided to an upper edge of the arm 66, and a hole into which the upper axis 60*b* of the eccentric axis 60 is fitted may be formed in a side surface of the bush. This is easier than processing for a long arm.

Also, in the above structure, under the condition where the stop screws 68 are slightly loosened, when a driver is inserted into a groove of the upper axis 60*b* of the eccentric axis 60 to rotate the eccentric axis 60, one of the side walls of the groove 67*a*, into which the lower axis 60*a* of the eccentric axis 60 is fitted, is pushed to thereby rotate the cylindrical guide 67 of the touch sensor 61 around the Z–Z' axis. Thus, the contacts 62 are adjusted to be perpendicular to or parallel to a center line of a main axis of a lathe. Thereafter, the slightly loosened stop screws 68 are tightened to complete the adjusting work.

Instead of the eccentric axis 60, a driver having the same shape as that of the eccentric axis 60 may be used to make adjustment, and after the adjustment, the driver may be removed. The same concept can be applied to the eccentric axis 40 in the second embodiment. Also, an upper surface of each of the eccentric axes 20, 40, 50 and 60 may include a hexagonal hole, and the eccentric axes may be rotated by a spanner with a hexagonal axis.

In the present invention, since the touch sensor can be attached to the arm with a simple mechanism such that the contacts of the touch sensor are finely adjusted to be perpendicular to or parallel to the center line of the main axis of the lathe with ease, fine adjustments can be performed in an extremely short time.

While the invention has been explained with reference to the specific embodiments of the invention, the explanation is illustrative, and the invention is limited only by the appended claims.

What is claimed is:

1. A touch sensor adapted to be attached to a processing machine, comprising:

an arm attached to the processing machine and having a reference surface, a housing attached to the arm, said housing containing a sensor section with a contact and having a flange with a reference surface perpendicular to the contact and contacting the reference surface of the arm, fastening device for fastening the housing to the arm, and an eccentrically rotating device including an eccentric axis having a first axis and a second axis eccentrically attached to the first axis, a circular hole formed in one of the housing and the arm and engaging the first axis, and an elongated slot provided in the other of the housing and the arm and engaging the second axis so that upon rotation of the eccentric axis, a position of the contact installed in the housing is adjusted relative to the arm.

2. A touch sensor according to claim 1, further comprising a fitting device formed in one of the housing and the arm for rotatably connecting the housing and the arm, when the eccentric axis is rotated, the second axis pushing a side portion of the elongated slot to rotate the housing.

3. A touch sensor according to claim 2, wherein said flange extends substantially perpendicularly to the housing, and said arm includes a second flange contacting the flange of the housing, said flange and the second flange being fixed together by the fastening device.

4. A touch sensor according to claim 3, wherein said second flange includes the circular hole engaging the first axis, and the flange of the housing includes the elongated slot with a wide portion at a side of the second flange, said second axis being located in the wide portion so that the eccentric axis does not come off the elongated slot.

5. A touch sensor according to claim 4, wherein said eccentric axis includes a third axis extending from the second axis and having a center axis corresponding to that of the first axis, said third axis extending upwardly from the flange of the housing, and an adjusting portion for rotating the eccentric axis.

6. A touch sensor according to claim 3, further comprising a base portion connected to the arm and having said second flange, said base portion having terminals and springs for urging the terminals upwardly, said housing having terminal shafts attached to the contact and extending downwardly from the flange so that when the housing is fixed to the base portion, the terminal shafts contact the terminals to electrically activate the contact.

7. A touch sensor according to claim 2, wherein said housing includes a cylindrical portion and an enlarged portion protruding outwardly from the cylindrical portion to form the flange, said circular hole being formed in the arm and said elongated slot being formed in the cylindrical portion.

8. A touch sensor according to claim 7, wherein said circular hole and the elongated slot orient toward a center of the cylindrical portion.

* * * * *